US012552426B2

(12) United States Patent
Akif et al.

(10) Patent No.: US 12,552,426 B2
(45) Date of Patent: Feb. 17, 2026

(54) MODELING TRAIN MOVEMENT DYNAMICS FOR TRAIN CONTROL

(71) Applicant: PROGRESS RAIL LOCOMOTIVE INC, LaGrange, IL (US)

(72) Inventors: Sammy Akif, Northlake, TX (US); Marcos Blanco Fernandes, Trophy Club, TX (US); Evan Whinery, Flower Mound, TX (US)

(73) Assignee: PROGRESS RAIL LOCOMOTIVE INC, LaGrange, IL (US)

( * ) Notice: Subject to any disclaimer, the term of this patent is extended or adjusted under 35 U.S.C. 154(b) by 219 days.

(21) Appl. No.: 18/423,072

(22) Filed: Jan. 25, 2024

(65) Prior Publication Data

US 2025/0242841 A1 Jul. 31, 2025

(51) Int. Cl.
*B61L 15/00* (2006.01)

(52) U.S. Cl.
CPC ..... *B61L 15/0058* (2024.01); *B61L 15/0072* (2013.01); *B61L 15/0081* (2013.01)

(58) Field of Classification Search
CPC ..... B61L 15/0058; B61L 15/0072; B61L 15/0081; B61L 2201/00; B61L 2201/02
USPC ..... 701/19, 20
See application file for complete search history.

(56) References Cited

U.S. PATENT DOCUMENTS

| | | | | |
|---|---|---|---|---|
| 6,125,311 | A | 9/2000 | Lo | |
| 6,853,889 | B2 | 2/2005 | Cole | |
| 6,980,894 | B1 | 12/2005 | Gordon | |
| 8,630,757 | B2 | 1/2014 | Daum | |
| 10,077,033 | B2 | 9/2018 | Oswald | |
| 11,332,173 | B2 | 5/2022 | Howard | |
| 2010/0174427 | A1 | 7/2010 | Sivasubramaniam | |
| 2021/0107545 | A1* | 4/2021 | Howard | B61L 25/025 |
| 2021/0261177 | A1 | 8/2021 | Lata | |
| 2021/0263527 | A1* | 8/2021 | Yazhemsky | G05D 1/245 |
| 2023/0159069 | A1* | 5/2023 | Brand | B61L 15/0081 701/19 |
| 2023/0334340 | A1* | 10/2023 | Neal, Jr. | G06N 20/00 |
| 2024/0229732 | A1* | 7/2024 | Abrosimov | B61L 15/0058 |

FOREIGN PATENT DOCUMENTS

RU 2470814 C2 12/2016

* cited by examiner

*Primary Examiner* — Erick R Solis

(57) ABSTRACT

Systems and methods for operating a train using a train model are described herein. A The train model is a concatenated version of an empirical model. The empirical model is corrected and optimized using data generated by an empirical physics engine. The optimization of the empirical model reduces the number of inputs into the model, allowing for a simpler version of the empirical model to be deployed on a train as the train model. The train model can allow a computation engine of the train to receive data and calculate one or more predicted behaviors of the train. The calculations are used by an engine controller to control various operational aspects of the train in real-time while the train is operating.

20 Claims, 4 Drawing Sheets

MODELING TRAIN MOVEMENT DYNAMICS FOR TRAIN CONTROL

TECHNICAL FIELD

The present disclosure relates generally to operating a train, and more particularly, to modeling train movement dynamics for train operation and control.

BACKGROUND

A train often includes one or more engines that provide motive force to one or more passenger or haul cars. The interactions between the cars, engine, and other attached components of the train involve complex static and dynamic forces when starting, stopping, and moving across various topographies. These forces can include, but are not limited to, resistances, motive forces, inertial forces, coupling forces, longitudinal and lateral forces, and the like. Understanding these forces and the impact that train variables have on those forces through the use of models (calculated train behavior) can help or reduce issues such as train derailments, energy management, safety, and wear and tear on train components. An example of these models is the estimation of the forces acting in the couplers between vehicles (in-train forces). The design of the couplers allows for slack between the connections and relies on dampening devices to prevent damage from aggressive, relative movements between vehicles. A goal may be to limit these forces as to prevent breaking the couplers and/or strong impacts that may cause accidents or network delays.

The number of variables used to build these models, however, can be significant, with each one potentially effecting the operation of the train. The variables can include, but are not limited to, the number of engines, the number of cars, the topography or weather, the tracks, the train, the loading of the train, and the like. With so many potential variables, using physics engines to perform simulations based on the models can require a significant computational power. Compounding the issue is the fact that these simulations may need to be run in real-time when the train is operating.

Some efforts have been made to use models for determining train operating parameters. For example, U.S. Pat. No. 10,077,033 to Oswald ("the '033 patent") describes a computer-implemented method for determining dynamic braking data for use in a braking model. The '033 patent describes controlling a braking system using a braking model. According to the '033, the braking model is modified based on an updated or new safety factor. The safety factor is calculated based on an expected dynamic braking force and specified retarding forces of the train. However, the system and method described in the '033 patent have some deficiencies. For example, the '033 patent is directed specifically to the braking system and does not account for other majors control available to the engineer such as the regulator (throttle). Further, the '033 patent does not address the issue of integrating a significant number of variables into a model that may affect braking and regulator operation.

Examples of the present disclosure are directed to overcoming deficiencies of such systems.

SUMMARY

In one aspect of the present disclosure, a train include a plurality of nodes to detect a plurality of train parameters, wherein the plurality of nodes generates node data, and a train controller, the train controller comprising a memory storing computer-executable instructions; and a processor in communication with the memory, the computer-executable instructions causing the processor to perform acts comprising receiving a train model from a train model generator, wherein the train model is an optimized version of an empirical model of the train, wherein the train model is used by a computation engine of the train controller to calculate a train behavior using the node data, receiving the node data from the plurality of nodes, calculating the train behavior by inputting at least a portion of the node data into the train model, generating a control output based on the calculated train behavior, and transmitting the control output to an engine controller.

In another aspect of the present disclosure, a method of operating a train includes receiving a train model from a train model generator, wherein the train model is an optimized version of an empirical model of the train, wherein the train model is used by a computation engine of a train controller to calculate a train behavior using node data of a plurality of nodes, receiving the node data from the plurality of nodes, calculating the train behavior by inputting at least a portion of the node data into the train model, generating a control output based on the calculated train behavior, and transmitting the control output to an engine controller.

In a still further aspect of the present disclosure, a train controller for controlling a train includes a memory storing computer-executable instructions, and a processor in communication with the memory, the computer-executable instructions causing the processor to perform acts comprising receiving a train model from a train model generator, wherein the train model is an optimized version of an empirical model of the train, wherein the train model is used by a computation engine of the train controller to calculate a train behavior using node data of a plurality of nodes, receiving the node data from the plurality of nodes, calculating the train behavior by inputting at least a portion of the node data into the train model, generating a control output based on the calculated train behavior, and transmitting the control output to an engine controller.

DETAILED DESCRIPTION

Figure 1:
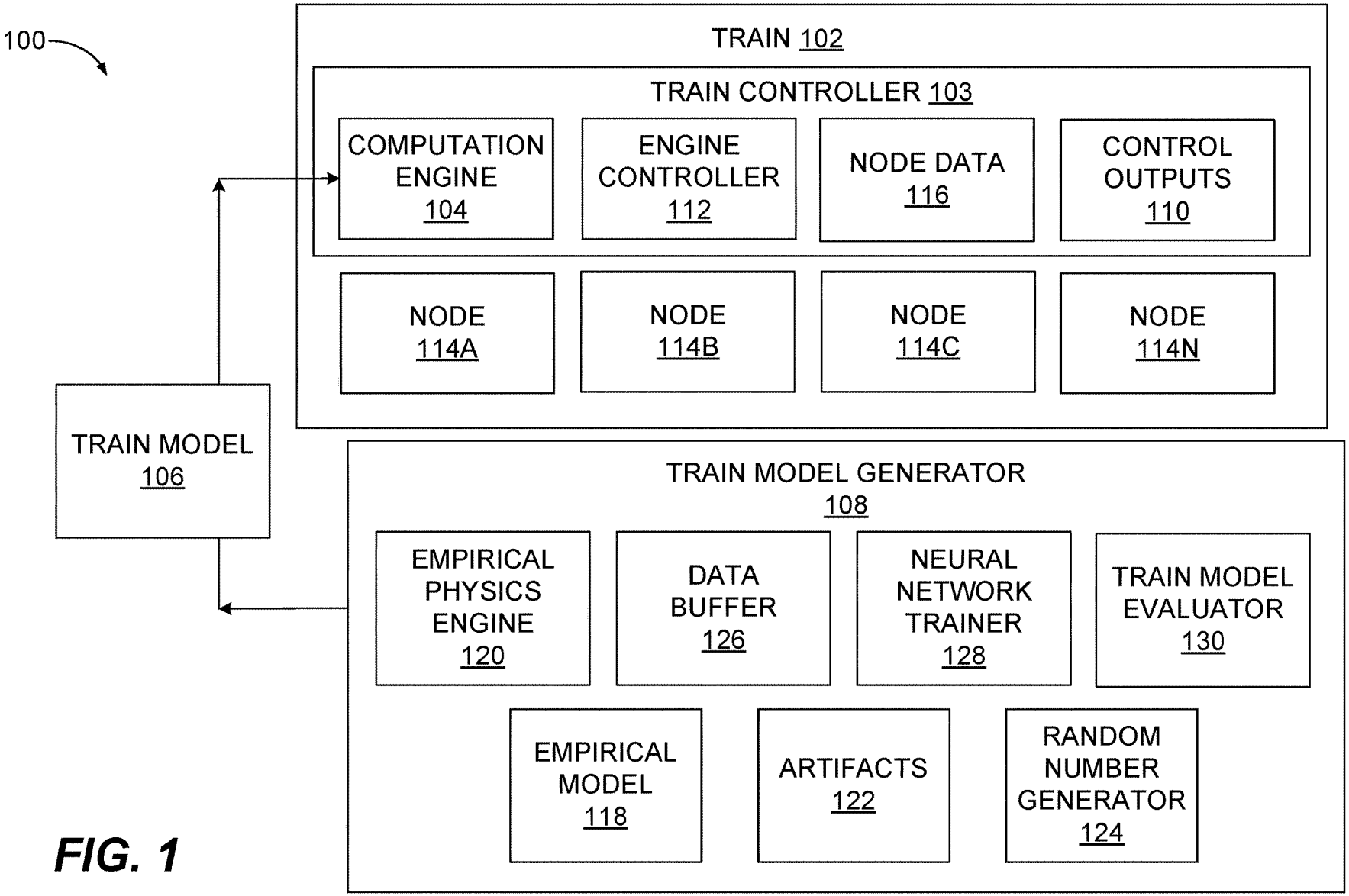
FIG. 1 is a schematic illustration of a combustion engine system that uses a mixer to mix a fuel into another fuel fed into an engine as a primary fuel, in accordance with one or more examples of the present disclosure.

Wherever possible, the same reference numbers will be used throughout the drawings to refer to same or like parts. Referring to the figures, FIG. 1 is a schematic illustration of a system 100 for operating a train 102 using a train controller 103, in accordance with one or more examples of the present disclosure. The train controller 103 includes a computation engine 104 that uses a train model 106 received from a train model generator 108 to calculate one or more control outputs 110 to control the train 102. The control outputs 110 are received by an engine controller 112 of the train controller 103 to control one or more aspects of the train 102 such as, but not limited to, braking, acceleration, warning signals/sounds, indicator lights, and the like. The presently disclosed subject matter is not limited to the type or number of the control outputs 110 that may be generated by the computation engine 104 using the train model 106.

In some examples, the train model 106 is an algorithm used by the computation engine 104 to predict train behavior based on or more inputs. In examples of the presently disclosed subject matter, the one or more inputs used by the computation engine 104 are nodes 114A-114N (hereinafter individually referred to as "the node 114A," "the node 114B," and the like, and collectively as "the nodes 114") of the train 102. For example, the nodes 114 are sensors that can detect train parameters including, but not limited to, brake input, regulator input, temperature sensors, accelerometers, vibration sensors, and the like. The presently disclosed subject matter is not limited to any particular type of node 114. The nodes 114 generate node data 116 that are inputs into the train model 106. The computation engine 104 uses the node data 116 and the train model 106 to generate the one or more control outputs 110. As noted above, the one or more control outputs 110 are received by the engine controller 112 to perform actions such as, but not limited to, applying brakes, reducing speed, issuing warning signals or sounds, limiting a train speed to below a speed setpoint, and the like.

For example, the computation engine 104 may receive as node data 116 from the nodes 114 train speed, weather, a speed limit of the track being travelled on, a topography of the ground upon which train rails are installed, accelerometers on one or more cars to measure acceleration, and the like. The computation engine 104 inputs the node data 116 into the train model 106 and calculates, in this example, that the speed of the train 102 is unsafe. The control output 110 can be one or more values that indicate one or more conditions of the train 102. These conditions can include, but are not limited to, excess car-to-car movement, excessive speed for braking capabilities, potential train component derailment, potential train damage, and the like. In some examples, the control output 110 can be an input to an engine controller 112 that the speed of the train 102 is excessive. The engine controller 112 can issue one or more control or indication outputs, such as an instruction to engage a braking system, an instruction to reduce or eliminate an ability of a regulator input to be changed, or an instruction to illuminate a warning light, and the like.

In some examples, the train model 106 is an algorithm generated using one or more techniques, such as machine learning. The train model 106 is used to make predictions or decisions based on the node data 116. However, the number of variables that may affect train behavior may be significant. Because the computation engine 104 may be installed on the train 102 itself thereby placing a limit on the size and computing capabilities of the computation engine 104, because the computation engine 104 may be used to provide real-time or near real-time control outputs 110, and/or because the computation engine 104 may only have a limited number or type of the nodes 114 in which to receive node data 116, the train model 106 may be a concatenated (e.g., fewer inputs into the algorithm) version of an empirical model 118 of the train 102. For example, as explained in more detail below, while the empirical model 118 may be an algorithm having hundreds or thousands of inputs, the train model 106 may have four or fewer inputs. With fewer inputs, in some examples, the behavior of the train 102 may be accurately predicted using fewer computational resources, faster, and using fewer sensors (nodes) using the train model 106 than what may be achievable using the empirical model 118.

The train model generator 108 uses an empirical physics engine 120 to convert the empirical model 118, which may be an algorithm that may not be practical for use on the train 102, into the train model 106, which may be usable on the train 102. As used herein, the empirical model 118 is an algorithm that uses artifacts 122 as inputs. The artifacts 122 are bounds or parameters that define different kinds or types of operational scenarios the train 102 may encounter. These scenarios include, but are not limited to, the number of engines, the number of cars, different speeds, different speed limits, ranges of speeds, ranges of acceleration, and the like. In some examples, values of the artifacts 122 may be generated using various technologies such as a random number generator 124. The random number generator 124 calculates values of the artifacts 122 to generate a number of scenarios that may be received by the empirical physics engine 120. In some examples, the number of scenarios may be used to encompass potential operational conditions the train 102 may be subjected to.

The empirical physics engine 120 is a computational resource that generates data based on the values of the artifacts 122 received from the random number generator 124. For example, the empirical physics engine 120 may use testing data, research, principles of physics, and the like to theoretically determine the behavior of a train, such as the train 102. For example, the random number generator 124 may change the theoretical position of the throttle control and determine train behavior (e.g., stall, speed up, reach an unsafe condition, etc.). The calculated behavior can include generally the train 102 or may be specific to one or more of the components of the train 102, such as specific cars, engines, wheels, etc. The data calculated by the empirical physics engine 120 is stored in a data buffer 126. The data may include, but is not limited to, state data, train handling data, fuel consumption, car behavior, and the like. In some examples, multiple iterations of calculations by the empirical physics engine 120 may be used to generate data for an increasing number of scenarios the train 102 may experience.

A neural network trainer 128 is used to convert the empirical model 118 into the train model 106. As noted above, the empirical model 118 is an unabridged algorithm that may have a significant number of inputs (artifacts). Because the empirical model 118 may require a significant amount of computing resources to be deployable on the train 102, the train model 106 is used instead. However, the train model 106 may still be required to be as accurate or nearly as accurate as the empirical model 118 when predicting train behavior. To accomplish the conversion, the data stored in the data buffer 126 or values calculated from the empirical physics engine 120 are fed into the empirical model 118. The calculated train behavior using the empirical model 118 is compared to expected values using a train model evaluator 130. Machine learning processes may be used to adjust values of the empirical model 118 based on the evaluation. The process of data entry and evaluation continues until the train behavior calculated by the empirical model 118 is within a predetermined range of the calculation performed by the empirical physics engine 120.

However, as discussed above, the computing resources available on the train 102 may be limited whereby the trained empirical model 118 may not be preferable for use on the train 102 using the computation engine 104. In these examples, to generate the train model 106 deployed on the train 102, the empirical model 118 may be optimized to reduce a number of the artifacts (or the nodes 114) used to generate accurate calculations of the train behavior, effectively converting the empirical model 118 into the train model 106. In this example, the neural network trainer 128 adjusts the artifacts inputted into the empirical model 118 and, using the train model evaluator 130, determines if the accuracy of the calculated train behavior is within a predetermined value. For example, an artifact may be the number of wheels on a car of the train 102. The neural network trainer 128 may input a null or zero value as the artifact value into the empirical model 118 to calculate a train behavior such as speed.

The train model evaluator may determine that the calculation is within 0.1 kph of the value calculated by the empirical physics engine 120 or the value previously generated using the empirical model 118 using the number of wheels on a car. Thus, as part of the optimization process, the neural network trainer 128 may modify the empirical model 118 by removing the number of wheels on a car as an artifact. Thus, when the train model 106 is generated, the train model 106 may not use that data. The neural network trainer 128 may continue to make these types of operations to further simplify the empirical model 118. In some examples, the neural network trainer 128 may continue the process to determine a minimum number of the nodes 114 needed so that the train behavior calculated using the optimized empirical model 118 is within a predetermined value of the empirical physics engine 120, the initial empirical model 118 (e.g., prior to the optimization process), or a prior (i.e., second, third, fourth, etc.) iteration of the empirical physics engine 120 (e.g., a version of the empirical model 118 generated during the optimization process).

The now optimized empirical model 118 may thereafter be deployed to the train 102 as the train model 106. In some examples, however, the train model 106 deployed to the train 102 may be updated. For example, a new artifact not previously used may be identified. The empirical physics engine 120 may calculate updated data for the data buffer 126. The updated data may be used by the neural network trainer 128 to determine what, if any, updates to the empirical model 118, and thereby the train model 106, may be needed. The train model 106 may also be updated using the node data 116. For example, one of the node data 116 may be the train behavior being modeled, such as train speed. The computation engine 104 may calculate train behavior using the train model 106 and determine that the calculated train behavior is not within a predetermined value of the actual train speed. The train 102 may transmit this data to the train model generator 108 or may use the computation engine 104 to change the train model 106 so that the calculated train behavior is within a predetermined value of the actual train behavior as determined using the node data 116.

In some examples, more than one type of the train model 106 may be determined. A first type of model may be a train-component model. This type of the train model 106 may be used to calculate a behavior of train components such as individual cars when the train motion is dynamic (i.e., the train is accelerating or decelerating). This model may be used to calculate a train behavior because transient forces between cars, such cushioning forces detected by sensors on couplers, can be used to detect events that may cause cars to separate, a train derailment, or car-to-car damage (e.g., excessive coupling force). The train-component model may be used to reduce or eliminate forces that may cause component damage. Another type of model may be a train-level model. This model may assume the train 102 is a singular component (i.e., no movement between cars, or static behavior). The train-level model may be used when the train is moving in a steady-state or near steady-state condition (e.g., generally a constant speed). In some examples, because the train-level model does not consider component-to-component behavior, the train-level model may allow other types of data to be used. In some examples, the train-component model of the train model 106 may be used when the speed of the train is changing, such as when the train is starting, stopping, accelerating, or braking. In other examples, the train-level model may be used when the train 102 is generally at one speed or the speed changes less than a predetermined value, such as +−5 kph.

Figure 2:
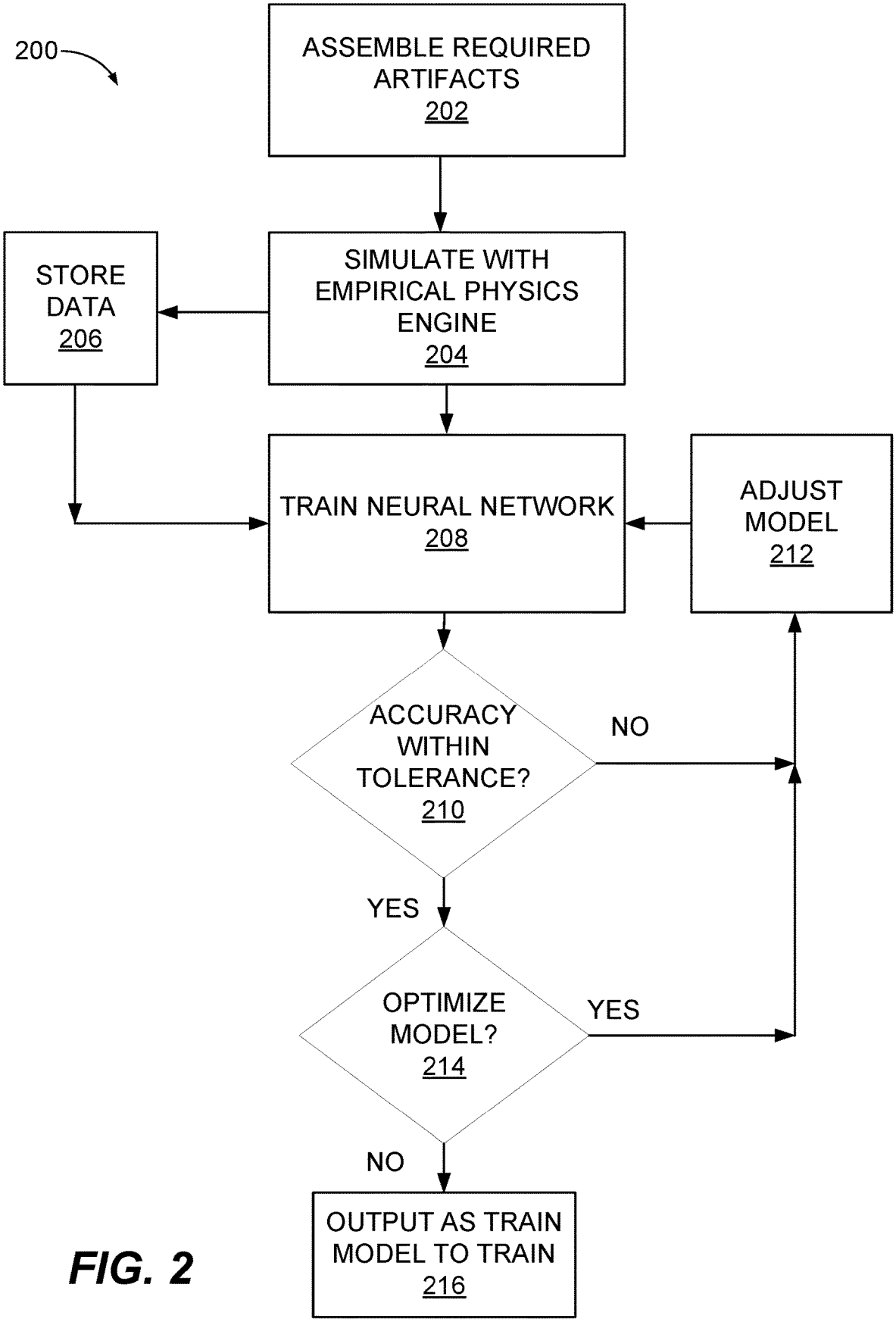
FIG. 2 illustrates a method for determining a train model used to operate a train, in accordance with various examples of the presently disclosed subject matter.

FIG. 2 illustrates a method 200 for determining the train model 106 used to operate the train 102, in accordance with various examples of the presently disclosed subject matter. The method 200 and other processes described herein are illustrated as example flow graphs, each operation of which may represent a sequence of operations that can be implemented in hardware, software, or a combination thereof. In the context of software, the operations represent computer-executable instructions stored on one or more tangible computer-readable storage media that, when executed by one or more processors, perform the recited operations. Generally, computer-executable instructions include routines, programs, objects, components, data structures, and the like that perform particular functions or implement particular abstract data types. The order in which the operations are described is not intended to be construed as a limitation, and any number of the described operations can be combined in any order and/or in parallel to implement the processes.

The method 200 commences at step 202, where the train model generator 108 assembles the artifacts to be used as variables for computing train behavior. The artifacts 122 are bounds or parameters that define different kinds or types of theoretical scenarios or configurations the train 102 may encounter. These scenarios include, but are not limited to, the number of engines, the number of cars, different speeds, different speed limits, ranges of speeds, ranges of acceleration, and the like. In some examples, values of the artifacts 122 may be generated using various technologies such as a random number generator 124. The random number generator 124 calculates values of the artifacts 122 to generate a number of scenarios that may be received by the empirical physics engine 120. In some examples, the number of scenarios may be used to encompass potential operational conditions the train 102 may be subjected to such as, but not limited to, different train configurations (cars, engines, train types, layouts, etc.), speed limit scenarios, ground topography scenarios, and the like.

At step 204, the empirical physics engine 120 is used to generate behavior data to be used to train the empirical model 118. The empirical physics engine 120 generates behavior data based on the values of the artifacts 122 received from the random number generator 124. The empirical physics engine 120 may use testing data, research, principles of physics, and the like to theoretically determine one or more behaviors of the train 102. For example, the random number generator 124 may change the theoretical position of the throttle control and determine train behavior (e.g., stall, speed up, reach an unsafe condition, etc.). The calculated behavior can include generally the train 102 or may be specific to one or more of the components of the train 102, such as specific cars, engines, wheels, etc.

At step 206, the behavior data calculated by the empirical physics engine 120 is stored in the data buffer 126. The data may include, but is not limited to, state data, train handling data, fuel consumption, car behavior, and the like. In some examples, multiple iterations of calculations by the empirical physics engine 120 may be used to generate data for an increasing number of scenarios the train 102 may experience.

At step 208, a neural network is trained by the neural network trainer 128. The neural network trainer 128 uses a generic or initial version of the empirical model 118 and uses that version to calculate one or more train behaviors using the data stored in the data buffer 126 at step 206. Step 208 is the process of converting the initial version of the empirical model 118 into the train model 106 that is deployed to the train 102.

At step 210, the neural network trainer 128 determines if the train behavior(s) calculated by the current version of the empirical model 118 is within a tolerance or predetermined value/range. For example, the empirical physics engine 120 may have calculated using a specific set of data that the train 102 speed should change by 5 kph. The tolerance may be plus or minus 2 kph. Thus, if the neural network trainer 128 calculates a train speed of 6 kph using the current version of the empirical model 118, the empirical model 118 may be within tolerance. However, if the neural network trainer 128 calculates a train speed of 10 kph using the current version of the empirical model 118, the empirical model 118 may be out of tolerance.

If at step 210 the neural network trainer 128 determines the current version of the empirical model 118 is out of tolerance, the method 200 continues to step 212 where the empirical model 118 is adjusted to an iteration (e.g., second, third, fourth, etc.) of the empirical model 118. A machine learning process may be used to adjust the algorithm of the empirical model 118 and rerun the training process by returning to step 208 using an updated version of the empirical model 118.

If at step 210 the neural network trainer 128 determines the current version of the empirical model 118 is within tolerance, the method 200 continues to step 214 where the neural network trainer 128 determines if the current version of the empirical model 118 that meet the tolerance requirement(s) of step 210 is to be optimized, e.g., have a reduced number of data inputs into the model.

If at step 214 the neural network trainer 128 determines that the current version of the empirical model 118 is to be optimized, the method 200 continues to step 212 where the neural network trainer 128 modifies the empirical model 118 by removing various data from the empirical model 118 to generate optimization data. The method 200 then continues to step 208, where the updated empirical model 118 is tested again (i.e., retested) for accuracy using the optimization data. The empirical model 118 is continually adjusted by retesting based on a determination of accuracy. The neural network trainer 128 may continue to perform these types of operations to further simplify the empirical model 118.

If at step 214 the neural network trainer 128 determines that the current version of the empirical model 118 is not to be optimized, the method 200 continues to step 216, where the train model generator 108 deploys the current version of the empirical model 118 to the train 102 as the train model 106. As noted above, even after the train model 106 is deployed to the train 102, the method 200 may be continued by the train model generator 108 to further optimize the train model 106 to provide an updated train model 106 to the train 102 for use by the train 102 to control one or more aspects of the train, described in more detail in FIG. 3, below.

Figure 3:
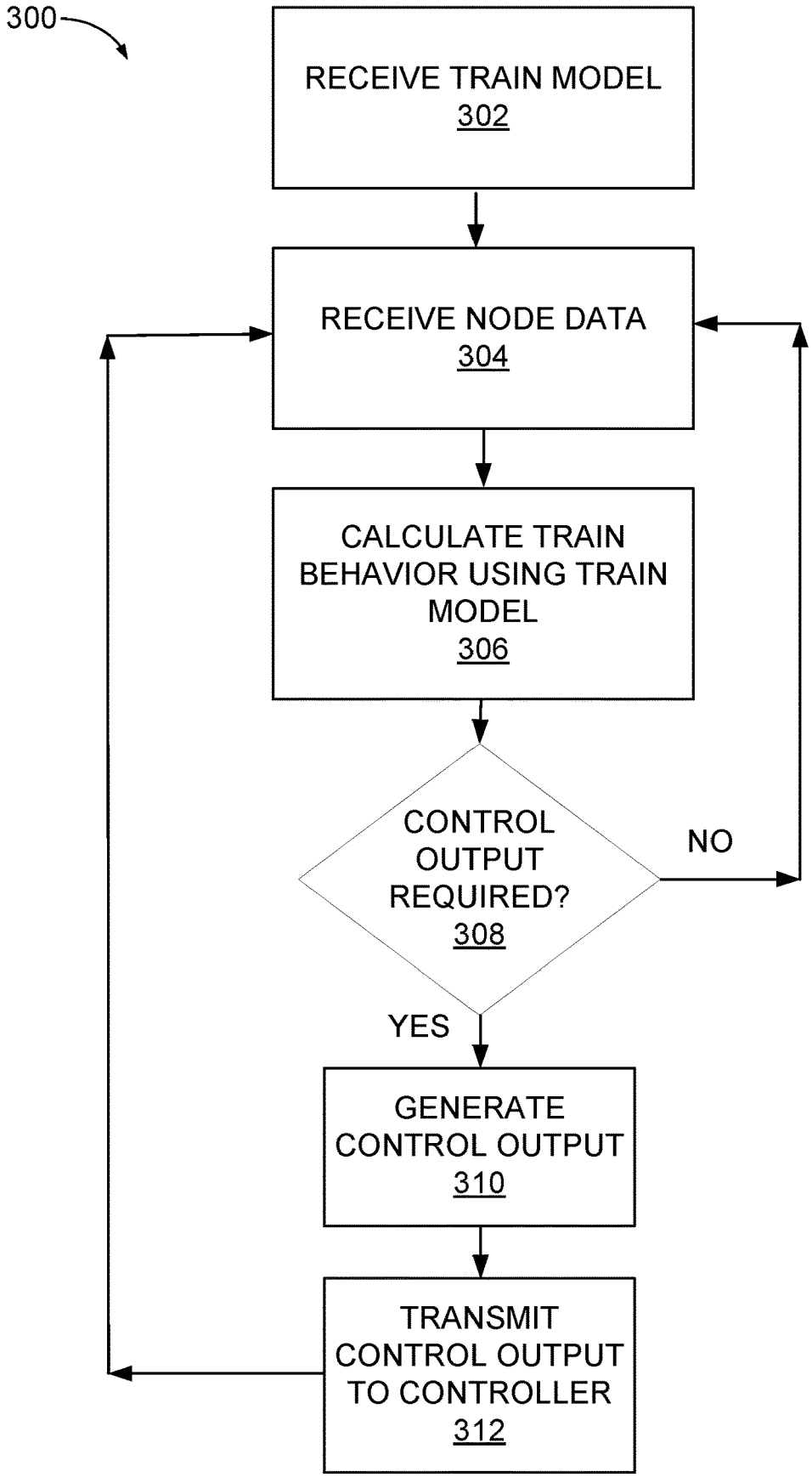
FIG. 3 illustrates a method for using a train model to control a train by a train controller, in accordance with various examples of the presently disclosed subject matter.

FIG. 3 is a method 300 for using the train model 106 to control the train 102 by the train controller 103, in accordance with various examples of the presently disclosed subject matter. The method 300 commences at step 302, where the computation engine 104 receives the train model 106 from the train model generator 108. An example process for generating the train model 106 was described above in FIG. 2. As noted above, the train model 106 may be one or more algorithms that are used to calculate one or more train behaviors using the node data 116 such as a train-component model or a train-level model as described above. It should be noted that step 302 may be continually performed to update the train model 106.

At step 304, where the computation engine 104 receives the node data 116 provided by the nodes 114. The node data 116 can include, but is not limited to, train speed, weather experienced by the train 102, a speed limit of the track being travelled on, a topography of the ground upon which train rails are installed, accelerometers on one or more cars to measure acceleration, positions of controls such as the regulator and brake, and the like.

At step 306, the computation engine 104 calculates one or more train behaviors using the train model 106. The train behaviors can include an estimated train speed, forces on the train, an acceleration of the train, a relative acceleration of the components of the train, and the like.

At step 308, the computation engine 104 determines if a control output 110 is required based on the calculation performed at step 306. For example, the computation engine 104 may calculate that the expected train speed is above a predetermined setpoint (such as a maximum train speed or a speed limit). In another example, the computation engine 104 may calculate that the relative speed or acceleration between one or more cars exceeds a predetermined setpoint.

If at step 308 the computation engine 104 determines that no control output 110 is required, the method 300 continues to step 304, whereby the computation engine 104 receives the node data 116. It should be noted that the computation engine 104 may be continually receiving the node data at any step of the method 300.

If at step 308 the computation engine 104 determines that a control output 110 is required, the method 300 continues to step 310, where the computation engine 104 generates the control output 110. The control output 110 can be a warning light, limiter on the regulator, or the initiation of the brakes of the train.

At step 312, the engine controller 112 receives the control output 110 and provides instructions to one or more systems of the train 102 based on the control output 110. For example, if the control output 110 is to engage the brakes of the train 102, the engine controller 112 may engage the brakes. The method 300 continues at step 304, whereby the computation engine 104 continues to receive the node data 116. The train controller 103 is described in more detail in FIG. 4, below.

Figure 4:
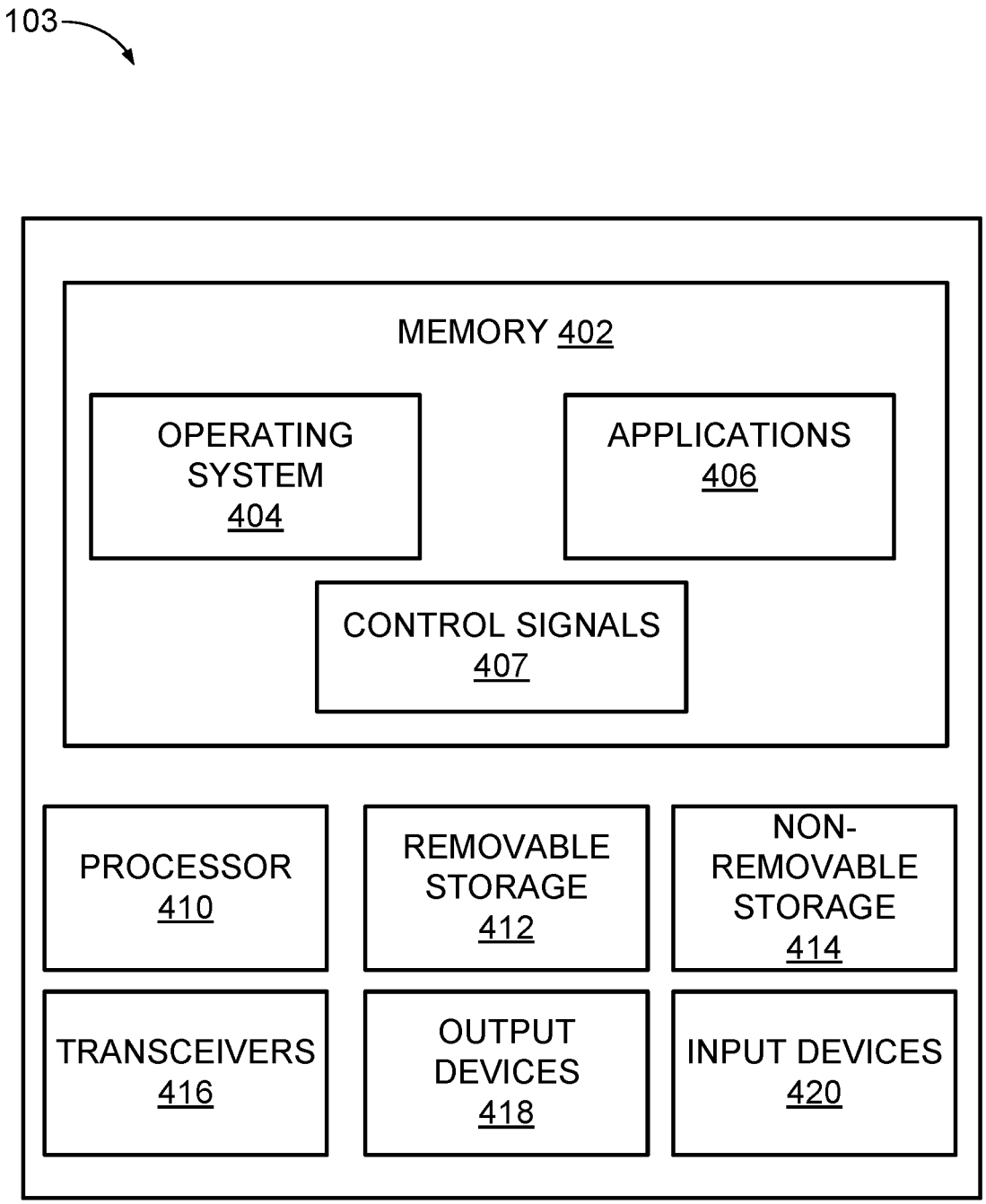
FIG. 4 depicts a component level view of an engine controller for use with the systems and methods described herein, in accordance with various examples of the presently disclosed subject matter.

FIG. 4 depicts a component level view of the train controller 103 for use with the systems and methods described herein, in accordance with various examples of the presently disclosed subject matter. The train controller 103 could be any device capable of providing the functionality associated with the systems and methods described herein. The train controller 103 can comprise several components to execute the above-mentioned functions. The train controller 103 may be comprised of hardware, software, or various combinations thereof. As discussed below, the train controller 103 can comprise memory 402 including an operating system (OS) 404 and one or more standard applications 406. The standard applications 406 may include applications that generate control signals 407 to operate the train 102 based on the control outputs 110 received from the computation engine 104.

The train controller 103 can also comprise one or more processors 410 and one or more of removable storage 412, non-removable storage 414, transceiver(s) 416, output device(s) 418, and input device(s) 420. In various implementations, the memory 402 can be volatile (such as random access memory (RAM)), non-volatile (such as read only memory (ROM), flash memory, etc.), or some combination of the two. The memory 402 can include data pertaining to the control signals 407 associated with the control outputs 110 received from the computation engine 104.

The memory 402 can also include the OS 404. The OS 404 varies depending on the manufacturer of the train controller 103. The OS 404 contains the modules and software that support basic functions of the train controller 103, such as scheduling tasks, executing applications, and controlling peripherals. The OS 404 can also enable the train controller 103 to send and retrieve other data and perform other functions, such as issue the control signals 407 to one or more systems of the train 102.

The train controller 103 can also comprise one or more processors 410. In some implementations, the processor(s) 410 can be one or more central processing units (CPUs), graphics processing units (GPUs), both CPU and GPU, or any other combinations and numbers of processing units. The train controller 103 may also include additional data storage devices (removable and/or non-removable) such as, for example, magnetic disks, optical disks, or tape. Such additional storage is illustrated in FIG. 4 by removable storage 412 and non-removable storage 414.

Non-transitory computer-readable media may include volatile and nonvolatile, removable and non-removable tangible, physical media implemented in technology for storage of information, such as computer readable instructions, data structures, program modules, or other data. The memory 402, removable storage 412, and non-removable storage 414 are all examples of non-transitory computer-readable media. Non-transitory computer-readable media include, but are not limited to, RAM, ROM, electronically erasable programmable ROM (EEPROM), flash memory or other memory technology, compact disc ROM (CD-ROM), digital versatile discs (DVD) or other optical storage, magnetic cassettes, magnetic tape, magnetic disk storage or other magnetic storage devices, or any other tangible, physical medium which can be used to store the desired information, which can be accessed by the train controller 103. Any such non-transitory computer-readable media may be part of the train controller 103 or may be a separate database, databank, remote server, or cloud-based server.

In some implementations, the transceiver(s) 416 include any transceivers known in the art. In some examples, the transceiver(s) 416 can include wireless modem(s) to facilitate wireless connectivity with other components (e.g., between the train controller 103 and one or more systems of the train 102), the Internet, and/or an intranet. Specifically, the transceiver(s) 416 can include one or more transceivers that can enable the train controller 103 to send the control signals 407, receive the control outputs 110, and/or receive the train model 106. Thus, the transceiver(s) 416 can include multiple single-channel transceivers or a multi-frequency, multi-channel transceiver to enable the train controller 103 to send and receive video calls, audio calls, messaging, etc. The transceiver(s) 416 can enable the train controller 103 to connect to multiple networks including, but not limited to 2G, 3G, 4G, 5G, and Wi-Fi networks. The transceiver(s) 416 can also include one or more transceivers to enable the train controller 103 to connect to future (e.g., 6G) networks, Internet-of-Things (IoT), machine-to machine (M2M), and other current and future networks.

The transceiver(s) 416 may also include one or more radio transceivers that perform the function of transmitting and receiving radio frequency communications via an antenna (e.g., Wi-Fi or Bluetooth®). In other examples, the transceiver(s) 416 may include wired communication components, such as a wired modem or Ethernet port, for communicating via one or more wired networks. The transceiver(s) 416 can enable the train controller 103 to facilitate audio and video calls, download files, access web applications, and provide other communications associated with the systems and methods, described above.

In some implementations, the output device(s) 418 include any output devices known in the art, such as a display (e.g., a liquid crystal or thin-film transistor (TFT) display), a touchscreen, speakers, a vibrating mechanism, or a tactile feedback mechanism. Thus, the output device(s) can include a screen or display. The output device(s) 418 can also include speakers, or similar devices, to play sounds or ringtones when an audio call or video call is received. Output device(s) 418 can also include ports for one or more peripheral devices, such as headphones, peripheral speakers, or a peripheral display.

In various implementations, input device(s) 420 include any input devices known in the art. For example, the input device(s) 420 may include a camera, a microphone, or a keyboard/keypad. The input device(s) 420 can include a touch-sensitive display or a keyboard to enable users to enter data and make requests and receive responses via web applications (e.g., in a web browser), make audio and video calls, and use the standard applications 406, among other things. A touch-sensitive display or keyboard/keypad may be a standard push button alphanumeric multi-key keyboard (such as a conventional QWERTY keyboard), virtual controls on a touchscreen, or one or more other types of keys or buttons, and may also include a joystick, wheel, and/or designated navigation buttons, or the like. A touch sensitive display can act as both an input device 420 and an output device 418.

INDUSTRIAL APPLICABILITY

The present disclosure relates generally to the use of the train model 106 to control various aspects of the train 102. The train model 106 is an algorithm that is an optimized and concatenated version of the empirical model 118. The train model 106 uses node data 116 received from the nodes 114 to determine if any control outputs 110 are required. In some uses, the amount of space on the train 102 available to install a computer (such as the computation engine 104) to calculate or predict train behavior may be limited. The limited space can limit the amount of processing power available to the computation engine 104. Using the larger, more complex empirical model 118 on the train 102 when processing power is limited can have some disadvantages. For example, the train model 106 may be used in dynamic situations when the train 102 is operating. Using a computation engine 104 that has limited processing power can delay the generation of control outputs 110 to the point that, when generated, the control outputs 110 are no longer useful. For example, the control output 110 may indicate that the predicted train speed is unsafe. However, if the computation engine 104 takes too long to generate the control output 110, the train 102 may have already experienced a catastrophic event. In another example, the limited processing power may be at a degree that the computation engine simply has insufficient resources to perform any calculations.

Thus, the systems and methods described herein convert the empirical model 118 into a train model 106 that may be suitable for the processing power available to the computation engine 104 and includes nodes 114 available on the train 102. For example, the empirical model 118 may include hundreds of artifacts (variable) that may not be provided as a node 114 on the train 102. If these artifacts not provided as node data 116 were included in the train model 106, the computation engine 104 may be performing unnecessary calculations or may perform erroneous calculations. In another example, the number of inputs used in the train model 106 may be reduced to a point that the computation engine 104 is able to receive the node data 116 and determine the control outputs 110 in a timeframe that the control outputs 110 can be used effectively to control the train 102.

Unless explicitly excluded, the use of the singular to describe a component, structure, or operation does not exclude the use of plural such components, structures, or operations or their equivalents. As used herein, the word "or" refers to any possible permutation of a set of items. For example, the phrase "A, B, or C" refers to at least one of A, B, C, or any combination thereof, such as any of: A; B; C; A and B; A and C; B and C; A, B, and C; or multiple of any item such as A and A; B, B, and C; A, A, B, C, and C; etc.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A train, comprising:

a plurality of nodes to detect a plurality of train parameters, wherein the plurality of nodes generates node data; and a train controller, the train controller comprising:

a memory storing computer-executable instructions; and a processor in communication with the memory, the computer-executable instructions causing the processor to perform acts comprising:

receiving a train model from a train model generator, wherein the train model is an optimized version of an empirical model of the train, wherein the train model is used by a computation engine of the train controller to calculate a train behavior using the node data;

receiving the node data from the plurality of nodes;

calculating the train behavior by inputting at least a portion of the node data into the train model;

generating a control output based on the calculated train behavior; and transmitting the control output to an engine controller.

2. The train of claim 1, wherein the train model is generated from the empirical model by:

assembling artifacts comprising variables for computing the train behavior;

inputting values of the artifacts into an empirical physics engine to generate behavior data, wherein the values of the artifacts are generated using a random number generator;

storing the behavior data in a data buffer;

testing an accuracy of an initial version of the empirical model by inputting the values of the artifacts into the initial version of the empirical model to generate empirical model data;

comparing the generated empirical model data to the behavior data to determine if the generated empirical model data is within a tolerance of the behavior data;

if the generated empirical model data is within a tolerance of the behavior data, optimizing the empirical model to generate the train model; and if the generated empirical model data is not within a tolerance of the behavior data, adjusting the empirical model to an iteration of the empirical model and retesting the accuracy of the iteration of the empirical model.

3. The train of claim 2, wherein optimizing the empirical model to generate the train model comprises:

removing one or more of the artifacts from the empirical model being optimized;

testing the empirical model being optimized by inputting the values of the artifacts not removed from the empirical model to generate optimization data;

comparing the optimization data to the behavior data to determine if the optimization data is within a tolerance of the behavior data;

if the generated empirical model data is within a tolerance of the behavior data, further optimizing the empirical model by removing additional artifacts and retesting the accuracy of the empirical model;

if the generated empirical model data is not within a tolerance of the behavior data, adjusting the empirical model being optimized and retesting the accuracy of being optimized; and outputting an optimized empirical model as the train model.

4. The train of claim 1, wherein the node data comprises a train speed, weather, a speed limit of a track being travelled on by the train, a topography of a ground upon which train rails are installed, an accelerometer on a car of the train, a position of a control of the train.

5. The train of claim 1, wherein the train behavior comprises an estimated train speed, a force on the train, an acceleration of the train, and a relative acceleration of cars of the train.

6. The train of claim 1, wherein the train model is a train-component model used to calculate a behavior of train components or a train-level model used to calculate a behavior of the train.

7. The train of claim 6, wherein the train-component model is used to calculate the behavior when a train motion is dynamic, and wherein the train-level model is used to calculate the behavior when the train motion is steady-state.

8. The train of claim 1, wherein the controller further comprises computer-executable instructions that cause the processor to perform acts comprising receiving an updated train model.

9. The train of claim 1, wherein the control output comprises an instruction to engage a braking system, an instruction to reduce or eliminate an ability of a regulator input to be changed, or an instruction to illuminate a warning light.

10. A method of operating a train, the method comprising:

receiving a train model from a train model generator, wherein the train model is an optimized version of an empirical model of the train, wherein the train model is used by a computation engine of a train controller to calculate a train behavior using node data of a plurality of nodes;

receiving the node data from the plurality of nodes;

calculating the train behavior by inputting at least a portion of the node data into the train model;

generating a control output based on the calculated train behavior; and transmitting the control output to an engine controller.

11. The method of claim 10, further comprising generating the train model from the empirical model by:

assembling artifacts comprising variables for calculating the train behavior;

inputting values of the artifacts into an empirical physics engine to generate behavior data, wherein the values of the artifacts are generated using a random number generator;

storing the behavior data in a data buffer;

testing an accuracy of an initial version of the empirical model by inputting the values of the artifacts into the initial empirical model to generate empirical model data;

comparing the generated empirical model data to the behavior data to determine if the generated empirical model data is within a tolerance of the behavior data;

if the generated empirical model data is within a tolerance of the behavior data, optimizing the empirical model to generate the train model; and if the generated empirical model data is not within a tolerance of the behavior data, adjusting the empirical model to an iteration of the empirical model and retesting the accuracy of the iteration of the empirical model.

12. The method of claim 11, wherein optimizing the empirical model to generate the train model comprises:

removing one or more of the artifacts from the empirical model being optimized;

testing the empirical model being optimized by inputting the values of the artifacts not removed from the empirical model to generate optimization data;

comparing the optimization data to the behavior data to determine if the optimization data is within a tolerance of the behavior data;

if the generated empirical model data is within a tolerance of the behavior data, further optimizing the empirical model by removing additional artifacts and retesting the accuracy of the empirical model;

if the generated empirical model data is not within a tolerance of the behavior data, adjusting the empirical model being optimized and retesting the accuracy of being optimized; and outputting an optimized empirical model as the train model.

13. The method of claim 10, wherein the node data comprises a train speed, weather, a speed limit of a track being travelled on by the train, a topography of a ground upon which train rails are installed, an accelerometer on a car of the train, a position of a control of the train.

14. The method of claim 10, wherein the train behavior comprises an estimated train speed, a force on the train, an acceleration of the train, and a relative acceleration of cars of the train.

15. The method of claim 10, wherein the train model is a train-component model used to calculate a behavior of train components or a train-level model used to calculate a behavior of the train.

16. The method of claim 15, wherein the train-component model is used to calculate the behavior when a train motion is dynamic, and wherein the train-level model is used to calculate the behavior when the train motion is steady-state.

17. The method of claim 10, further comprising receiving an updated train model.

18. The method of claim 10, further comprising, using the control output, engaging a braking system, reducing or eliminating an ability of a regulator input to be changed, or illuminating a warning light.

19. A train controller for controlling a train, the train controller comprising:

a memory storing computer-executable instructions; and a processor in communication with the memory, the computer-executable instructions causing the processor to perform acts comprising:

receiving a train model from a train model generator, wherein the train model is an optimized version of an empirical model of the train, wherein the train model is used by a computation engine of the train controller to calculate a train behavior using node data of a plurality of nodes;

receiving the node data from the plurality of nodes;

calculating the train behavior by inputting at least a portion of the node data into the train model;

generating a control output based on the calculated train behavior; and transmitting the control output to an engine controller.

20. The train controller of claim 19, wherein the controller further comprises computer-executable instructions that cause the processor to perform acts, based on the control output, comprising engaging a braking system, reducing or eliminating an ability of a regulator input to be changed, or illuminating a warning light.

* * * * *